US008433091B2

(12) United States Patent
Chen et al.

(10) Patent No.: US 8,433,091 B2
(45) Date of Patent: Apr. 30, 2013

(54) ULTRA-THIN LOUDSPEAKER STRUCTURE

(75) Inventors: Cheng-Hsiung Chen, Banqiao (TW); Hsiang-Chih Yu, Zhonghe (TW); Chu-You Hsieh, Xizhi (TW); Chin-Chou Yang, Danshui Township, Taipei County (TW)

(73) Assignees: Abatech Electronics Co., Ltd., Taipei County (TW); Hsiang-Chih Yu, Taipei County (TW)

( * ) Notice: Subject to any disclaimer, the term of this patent is extended or adjusted under 35 U.S.C. 154(b) by 214 days.

(21) Appl. No.: 12/983,328

(22) Filed: Jan. 3, 2011

(65) Prior Publication Data

US 2012/0170796 A1 Jul. 5, 2012

(51) Int. Cl.
*H04R 25/00* (2006.01)
*H04R 1/00* (2006.01)

(52) U.S. Cl.
USPC ..... 381/423; 381/190; 381/431

(58) Field of Classification Search ..... 381/150, 381/396, 423, 190, 431
See application file for complete search history.

(56) References Cited

U.S. PATENT DOCUMENTS 6,904,154 B2 * 6/2005 Azima et al. ..... 381/431
2003/0081800 A1 * 5/2003 Klasco et al. ..... 381/431

* cited by examiner

*Primary Examiner* — Brian Ensey
(74) *Attorney, Agent, or Firm* — Leong C. Lei

(57) ABSTRACT

An ultra-thin loudspeaker structure comprises an upper drum paper, a lower drum paper, and a steel sheet. The lower drum paper defines an opening at a center thereof and is integrally formed with a surrounding raised paper section near a periphery thereof. The upper drum paper defines an opening, corresponding to the opening of the lower drum paper, at a center thereof. The upper drum paper is located within the surrounding raised paper section and adhered to the lower drum paper by its periphery. The steel sheet is provided with a sound-making member stacked by a plurality of ceramic material layer, and is sandwiched between the drum papers. Accordingly, the steel sheet can facilitate spreading sound of high and medium frequency whereas the drum papers can facilitate spreading sound of low frequency, to achieve a better reproduction of sound.

3 Claims, 6 Drawing Sheets

ULTRA-THIN LOUDSPEAKER STRUCTURE

BACKGROUND OF THE INVENTION (a) Technical Field of the Invention

The present invention relates to an ultra-thin loudspeaker structure, and more particularly to an ultra-thin loudspeaker structure in which sound can be radiated outwards through a steel sheet, an upper drum paper, and a lower drum paper when a sound-making member receives audio signal, which thus is applied to thinned products such as i-pad, i-phone or mobile phones, headphones, speaker boxes and notebook computers, and which is convenient to fabricate and assemble.

(b) Description of the Prior Art

With the rapid progress of science and technology, common 3C products such as i-pad, i-phone or mobile phones, headphones, speaker boxes and notebook computers have been developed to be thinner and smaller. Correspondingly, components used in these 3C products become thinner. With regard to loudspeakers for making sounds, conventional loudspeakers can be miniaturized, but can not become thinner and lighter, thus saving power and consumptions. As a result, the conventional loudspeakers cannot meet requirements of the products. Furthermore, as for a miniaturized loudspeaker, a reproduction of high, medium and low audio frequencies needs to be considered, so that it is really unacceptable for a dealer and a consumer that the loudspeaker gets a thinned configuration at the expense of its audio frequency effects. In view of the above, the applicant of the present invention has made improvements to make thin loudspeakers convenient to fabricate and assemble and produce better sound effects after years of experience and continuous research and experiments in this field.

SUMMARY OF THE INVENTION

A main object of the present invention is to provide an ultra-thin loudspeaker structure, in which sound can be radiated outwards through a steel sheet, an upper drum paper, and a lower drum paper when a sound-making member receives audio signal, which thus is applied to thinned products such as i-pad, i-phone or mobile phones, headphones, speaker boxes and notebook computers, and which is convenient to fabricate and assemble and produce better sound effects.

The ultra-thin loudspeaker structure includes an upper drum paper, a lower drum paper and a steel sheet. The lower drum paper defines an opening at a center thereof and is integrally formed with a surrounding raised paper section near a periphery thereof. The upper drum paper defines an opening, which corresponds to the opening of the lower drum paper, at a center thereof, wherein the upper drum paper has a dimension substantially equal to an area of the lower drum paper surrounded by an inner edge of the surrounding raised paper section, and the upper drum paper is located within the surrounding raised paper section and adhered to the lower drum paper by its periphery. The steel sheet is sandwiched between the upper drum paper and the lower drum paper, wherein the steel sheet is provided with a sound-making member at a center thereof corresponding to the openings of the lower and upper drum papers, the steel sheet has a dimension less than the area surrounded by the inner edge of the surrounding raised paper section, and the steel sheet is fixed to the drum papers by its periphery, thereby sealing the openings of the drum papers. As such, the steel sheet can facilitate spreading sound of high and medium frequency whereas the drum papers can facilitate spreading sound of low frequency, to achieve a better reproduction of sound. Therefore, the loudspeaker structure is applied to thinned products such as i-pad, i-phone or mobile phones, headphones, speaker boxes and notebook computers.

In the above ultra-thin loudspeaker structure, the upper drum paper and the lower drum paper are made of base paper, cloth, wood chip or foam, polyethylene terephthalate (PET), polyethylene naphthalate (PEN), polyetherimide (PEI), etc.

DETAILED DESCRIPTION OF THE PREFERRED EMBODIMENTS

Figure 1:
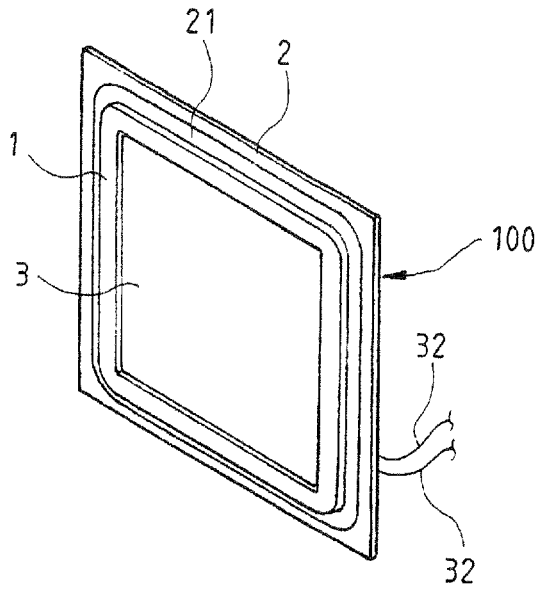
FIG. 1 is a three-dimensional view of the present invention.
Figure 2:
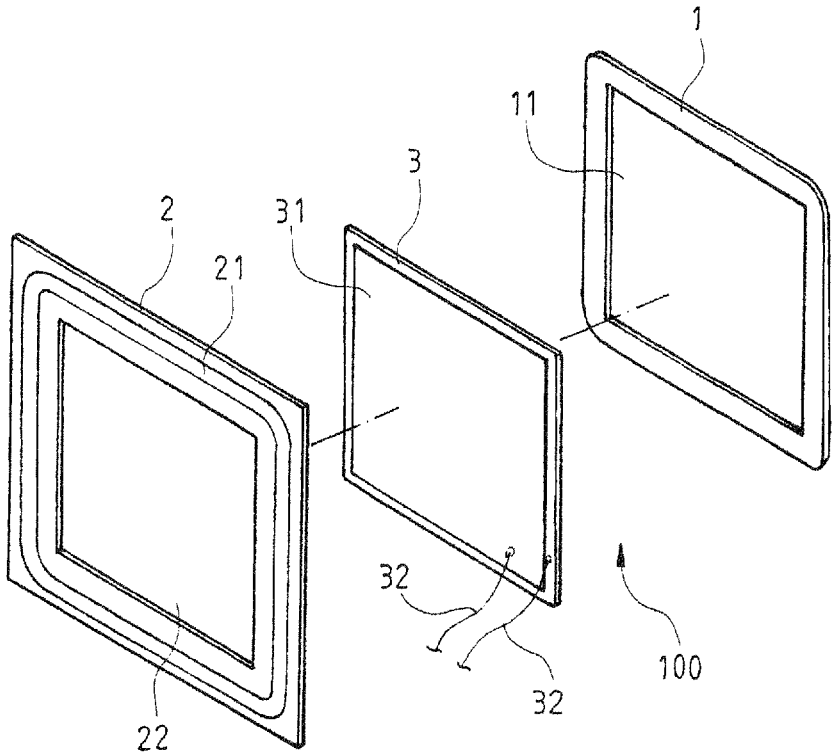
FIGS. 2 and 3 are three-dimensional exploded views of the present invention.
Figure 3:
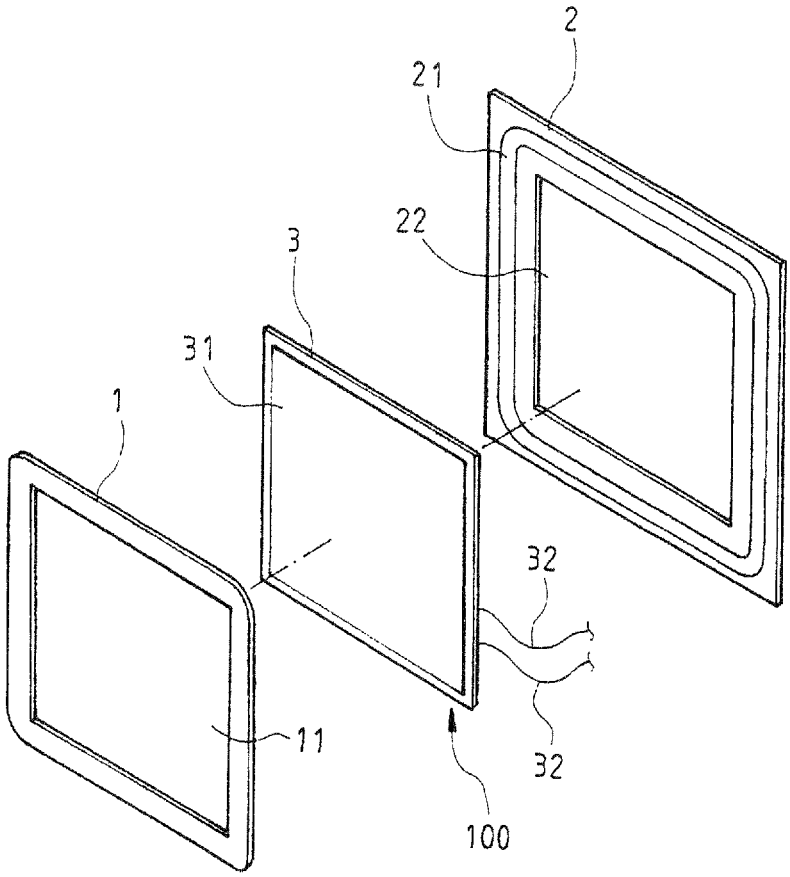

FIG. 1, FIG. 2 and FIG. 3 are respectively a three-dimensional view, two three-dimensional exploded views of the present invention. Referring to FIG. 1, FIG. 2 and FIG. 3, one embodiment of the present invention mainly includes an upper drum paper 1, a lower drum paper 2 and a steel sheet 3. In this embodiment, the lower drum paper 2 is made of base paper, cloth, wood chip or foam, polyethylene terephthalate (PET), polyethylene naphthalate (PEN), polyetherimide (PEI), etc. The lower drum paper 2 is designed to be square or circular. The lower drum paper 2 defines an opening 22, which can be a square opening as shown in the embodiment, at a center thereof and is integrally formed with a surrounding raised paper section 21 near a periphery thereof. The surrounding raised paper section 21 may have a curved cross-section, such as an arch-shaped one or a semi-circular one.

The upper drum paper 1 is made of base paper, cloth, wood chip or foam, polyethylene terephthalate (PET), polyethylene naphthalate (PEN), polyetherimide (PEI), etc. The upper drum paper 1 is smaller than the lower drum paper 2 and defines an opening 11, which corresponds to the opening 22 of the lower drum paper 2, at a center thereof, wherein the upper drum paper 1 has a dimension substantially equal to an area of the lower drum paper 2 surrounded by an inner edge of the surrounding raised paper section 21, and the upper drum paper 1 is located within the surrounding raised paper section 21 and adhered to the lower drum paper 2 by its periphery.

The steel sheet 3, which is smaller than the upper drum paper 1, is sandwiched between the upper drum paper 1 and the lower drum paper 2. The steel sheet 3 is provided with a sound-making member 31, which can be stacked by a plurality of ceramic material layers, at a center thereof corresponding to the openings 11, 22 of the drum papers 1, 2, wherein the steel sheet 3 has a dimension less than the area surrounded by the inner edge of the surrounding raised paper section 21, and the steel sheet 3 is fixed to the drum papers 1, 2 by its periphery, thereby sealing the openings 11, 12 of the drum papers 1, 2. Electrical wires 32 are soldered to the sound-making member 31 of the steel sheet 3.

With a combination of the aforementioned members, the steel sheet 3 is sandwiched between the upper drum paper 1 and the lower drum paper 2, and the upper drum paper 1 is located within the surrounding raised paper section 21 of the lower drum paper 2 and adhered to the lower drum paper 2 via an adhesive, and thus a thin loudspeaker 100 is formed. The electrical wires 32 can be connected to post-stage amplification circuits of different products. When the sound-making member 31 receives audio signal, sound can be radiated outwards through the steel sheet 3, the upper drum paper 1 and the lower drum paper 2. Therefore, the loudspeaker structure is applied to thinned products such as i-pad, i-phone or mobile phones, headphones, speaker boxes and notebook computers.

Figure 4:
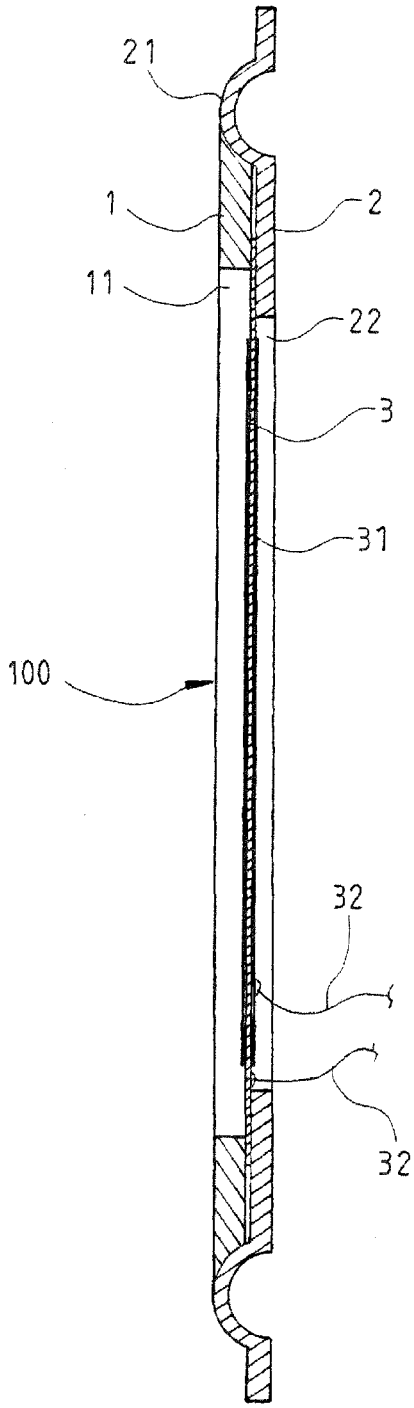
FIG. 4 is a sectional view of the present invention.
Figure 5:
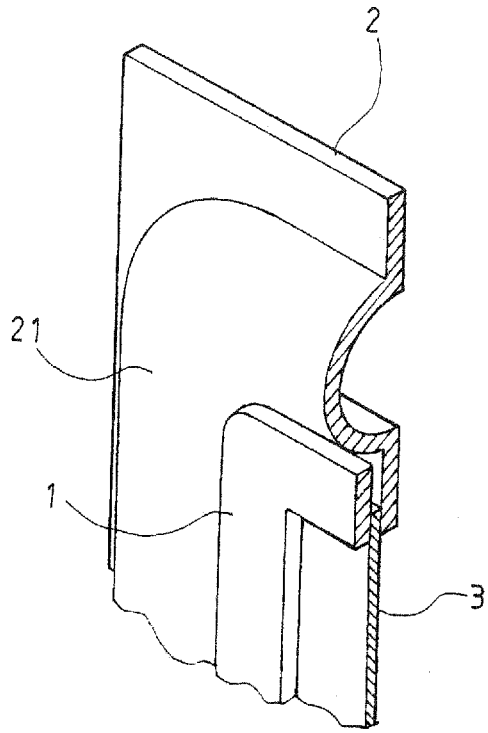
FIG. 5 is a partially enlarged sectional view of the present invention.

FIG. 4 and FIG. 5 are respectively a sectional view and a partially enlarged sectional view of the present invention. In designing a loudspeaker, the ideal material for a diaphragm should be rigid, light, and well damped. In the present invention, the steel sheet 3 is rigid whereas the drum papers 1, 2 are well damped. With the combination of the steel sheet 3 and the drum papers 1, 2, a better design of loudspeaker can be achieved. As such, the steel sheet 3 can facilitate spreading sound of high and medium frequency whereas the lower drum paper 2 and upper drum paper 1 can facilitate spreading sound of low frequency, to achieve a better reproduction of sound. The surrounding raised paper section 21 of the lower drum paper 2 can further increase the damping effect of the papers, thereby improving the quality of the sound generated by the sound-making member 31.

Figure 6:
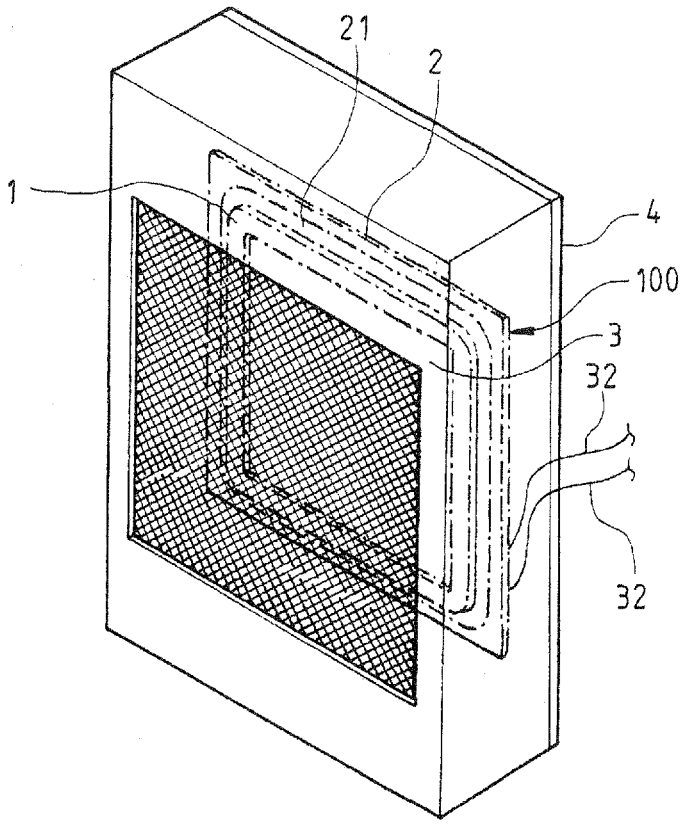
FIG. 6 is a view of an embodiment of the present invention.

FIG. 6 is a view of an embodiment of the present invention. Referring to FIG. 6, the loudspeaker structure of the present invention can be applied to thinned products such as i-pad, i-phone or mobile phones, headphones, speaker boxes and notebook computers. Furthermore, the whole thin loudspeaker 100 can be fixed in a speaker box 4, and likewise, the electrical wires 32 are connected to post-stage amplification circuits of different products (such as an amplifier or OP AMP). When the sound-making member 31 receives audio signal, sound can be radiated outwards through the steel sheet 3, the upper drum paper 1, and the lower drum paper 2, and then the sound can be radiated out of the speaker box 4. In the loudspeaker structure, the steel sheet 3 can facilitate spreading sound of high and medium frequency whereas the drum papers 1, 2 can facilitate spreading sound of low frequency, so that a better reproduction of sound can be achieved and thus the sound quality can be improved.

Compared with a conventional thin loudspeaker, the present invention has at least the following advantages:

1. The loudspeaker of the present invention is further thinned, so that it can be used more widely.

2. The steel sheet 3, which is sandwiched between the drum papers 1, 2, can facilitate spreading sound of high and medium frequency. Therefore, a better reproduction of sound at high and medium frequency can be achieved.

3. The drum papers 1, 2 can facilitate spreading sound of low frequency, which can even reach 200 Hz. Therefore, a better reproduction of sound at low frequency can be achieved.

4. The surrounding raised paper section 21 of the lower drum paper 2 can increase the damping effect of the drum papers 1, 2, so that the sound of low frequency can be spread more easily.

5. Without the magnets and voice coils of the conventional loudspeaker, the loudspeaker of the present invention conforms to the energy saving, power-saving and environmental protection requirements.

In summary, the present invention uses an upper drum paper, a lower drum paper, together with a steel sheet sandwiched between the upper drum paper and the lower drum paper to form an ultra-thin loudspeaker. When the sound-making member receives audio signal, sound can be radiated outwards through the steel sheet, the upper drum paper, and the lower drum paper. In the loudspeaker structure, the steel sheet can facilitate spreading sound of high and medium frequency whereas the drum papers can facilitate spreading sound of low frequency. Therefore, the loudspeaker of the present invention is applied to thinned products such as i-pad, i-phone or mobile phones, headphones, speaker boxes and notebook computers, and is convenient to fabricate and assemble and produce better sound effects.

We claim:

1. An ultra-thin loudspeaker structure, comprising:

a lower drum paper defining an opening at a center thereof and being integrally formed with a surrounding raised paper section near a periphery thereof;

an upper drum paper being smaller than the lower drum paper and defining an opening, which corresponds to the opening of the lower drum paper, at a center thereof, the upper drum paper having a dimension substantially equal to an area of the lower drum paper surrounded by an inner edge of the surrounding raised paper section, the upper drum paper being located within the surrounding raised paper section and adhered to the lower drum paper by its periphery; and a steel sheet sandwiched between the upper drum paper and the lower drum paper, wherein the steel sheet is provided with a sound-making member at a center thereof corresponding to the openings of the lower and upper drum papers, the steel sheet having a dimension less than the area surrounded by the inner edge of the surrounding raised paper section, the steel sheet being fixed to the lower and upper drum papers by its periphery, thereby sealing the openings of the drum papers;

whereby, the steel sheet can facilitate spreading sound of high and medium frequency whereas the drum papers can facilitate spreading sound of low frequency, to achieve a better reproduction of sound.

2. The ultra-thin loudspeaker structure of claim 1, wherein the surrounding raised paper section has a semi-circular cross-section.

3. The ultra-thin loudspeaker structure of claim 2, wherein the upper drum paper and the lower drum paper are made of base paper, cloth, wood chip or foam, polyethylene terephthalate (PET), polyethylene naphthalate (PEN), and polyetherimide (PEI).

* * * * *